US005094746A

United States Patent [19]

Bush

[11] Patent Number: 5,094,746

[45] Date of Patent: Mar. 10, 1992

[54] FLOTATION PROCESS USING A MIXTURE OF COLLECTORS

[75] Inventor: James H. Bush, Mentor, Ohio

[73] Assignee: The Lubrizol Corporation, Wickliffe, Ohio

[21] Appl. No.: 539,104

[22] Filed: Jun. 15, 1990

[51] Int. Cl.[5] ..... B03D 1/012; B03D 1/014; B03D 1/02

[52] U.S. Cl. ..... 209/167; 252/61

[58] Field of Search ..... 209/166, 167; 252/61

[56] References Cited

U.S. PATENT DOCUMENTS

| | | | |
|---|---|---|---|
| 1,593,232 | 7/1926 | Whitworth . | |
| 1,726,647 | 9/1929 | Cadwell . | |
| 1,736,429 | 11/1929 | Cadwell . | |
| 1,893,018 | 1/1933 | Christmann | 209/166 |
| 2,038,400 | 4/1936 | Whitworth | 209/166 |
| 2,206,284 | 7/1940 | Jayne, Jr. | 252/9 |
| 2,919,025 | 12/1959 | Booth et al. | 209/166 |
| 3,086,653 | 4/1963 | Booth | 209/166 |
| 3,298,520 | 1/1967 | Bikales | 209/166 |
| 3,464,551 | 9/1969 | Falvey | 209/166 |
| 3,570,772 | 3/1971 | Booth et al. | 241/24 |
| 3,876,550 | 4/1975 | Holubec | 252/47.5 |
| 3,975,264 | 8/1976 | Bolth et al. | 209/166 |
| 4,040,950 | 8/1977 | Zipperian et al. | 209/166 |
| 4,283,017 | 8/1981 | Coale et al. | 241/24 |
| 4,372,864 | 2/1983 | McCarthy | 252/61 |
| 4,460,459 | 7/1984 | Shaw et al. | 209/9 |
| 4,514,293 | 4/1985 | Bresson et al. | 209/167 |
| 4,554,108 | 11/1985 | Kimble et al. | 260/455 A |
| 4,584,097 | 4/1986 | Fu et al. | 209/166 |
| 4,595,538 | 6/1986 | Kimble et al. | 260/502.56 |
| 4,618,461 | 10/1986 | Bergman et al. | 558/234 |
| 4,699,712 | 10/1987 | Unger | 209/166 |
| 4,879,022 | 11/1989 | Clark et al. | 209/166 |

FOREIGN PATENT DOCUMENTS 575908 5/1928 Fed. Rep. of Germany .

OTHER PUBLICATIONS

Taggart, "Handbook of Mineral Dressing—Ores & Industrial Minerals", John Wiley & Sons, (1946), pp. 12–09.

*Primary Examiner*—Stanley S. Silverman
*Assistant Examiner*—Thomas M. Lithgow
*Attorney, Agent, or Firm*—Frederick D. Hunter; Forrest L. Collins; James A. Cairns

[57] ABSTRACT

The present invention relates to improved process for beneficiating an ore-containing sulfide material. In particular, the process is useful for beneficiating ores and recovering metals such as gold, copper, lead, molybdenum, zinc, etc., from the ores. In one embodiment, the process comprises the steps of:

(1) forming a slurry comprising at least one crushed mineral-containing ore, water and a collector which is a mixture of (A) at least one metal salt of a phosphorus acid represented by the Formula:

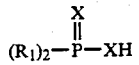

(I)

wherein each $R_1$ is independently a hydrocarbyl, hydrocarbyloxy or hydrocarbylthio group having from 1 to about 18 carbon atoms, each X is independently oxygen or sulfur, and the lowest oxidation state of the metal is plus two, and (B) at least one thio compound comprising (i) at least one dithiocarbamate represented by the formula:

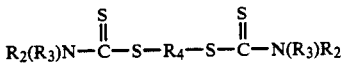

(II)

wherein each $R_2$ is independently hydrogen, a hydrocarbyl group having from 1 to about 18 carbon atoms, or $R_2$ taken together with $R_3$ and the nitrogen atom form a five, six or seven member heterocyclic group; each $R_3$ is independently a hydrocarbyl group having from 1 to about 18 carbon atoms, or $R_3$ taken together with $R_2$ and the nitrogen atom form a five, six or seven member heterocyclic group; and $R_4$ is a hydrocarbylene group having from 1 to about 10 carbon atoms, (ii) at least one thionocarbamate represented by the Formula

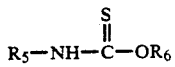

(III)

wherein $R_5$ and $R_6$ are hydrocarbyl groups having from 1 to about 18 carbon atoms or mixtures of (i) and (ii);

(2) subjecting the slurry from step (1) to froth flotation to produce a froth; and (3) recovering a mineral from the froth.

30 Claims, No Drawings

FLOTATION PROCESS USING A MIXTURE OF COLLECTORS

TECHNICAL FIELD OF THE INVENTION

This invention relates to froth flotation processes for the recovering of metal values from sulfide ores. More particularly, it relates to the use of a mixture of collectors.

BACKGROUND OF THE INVENTION

Froth flotation is one of the most widely used processes for beneficiating ores containing valuable minerals. It is especially useful for separating finely ground valuable minerals from their associated gangue or for separating valuable minerals from one another. The process is based on the affinity of suitably prepared mineral surfaces for air bubbles. In froth flotation, a froth or a foam is formed by introducing air into an agitated pulp of the finely ground ore in water containing a frothing or foaming agent. A main advantage of separation by froth flotation is that it is a relatively efficient operation at a substantially lower cost than many other processes.

It is common practice to include in the flotation process, one or more reagents called collectors or promoters that impart selective hydrophobicity to the valuable mineral that is to be separated from the other minerals. It has been suggested that the flotation separation of one mineral species from another depends upon the relative wettability of mineral surfaces by water. Many types of compounds have been suggested and used as collectors in froth flotation processes for the recovery of metal values. Examples of such types of collectors include the xanthates, xanthate esters, dithiophosphates, dithiocarbamates, trithiocarbonates, mercaptans and thionocarbonates. Xanthates and dithiophosphates have been employed extensively as sulfide collectors in froth flotation of base metal sulfide ores.

Dialkyldithiophosphoric acids and salts thereof such as the sodium, potassium or ammonium salts have been utilized as promoters or collectors in the beneficiation of mineral-bearing ores by flotation for many years. Early references to these compounds and their use as flotation promoters may be found in, for example, U.S. Pat. Nos. 1,593,232 and 2,038,400. Ammonium salt solutions of the dithiophosphoric acids are disclosed as useful in U.S. Pat. No. 2,206,284, and hydrolyzed compounds are disclosed as useful in U.S. Pat. No. 2,919,025.

The dialkyldithiophosphoric acids utilized as flotation promoters and collectors for sulfide and precious metal ores are obtained by reacting an alcohol with phosphorus and sulfur generally as $P_2S_5$. The acid obtained in this manner can then be neutralized to form a salt.

U S. Pat. No. 3,086,653 describes aqueous solutions of alkali and alkaline earth metal salts of phospho-organic compounds useful as promoters or collectors in froth flotation of sulfide ores. The phospho-organic compounds are neutralized $P_2S_5$-alkanol reaction products. Although single alcohols are normally used in the reaction, the patentees disclose that mixtures of isomers of the same alcohol, and mixtures of different alcohols may be utilized as starting materials in the preparation of the phosphorus compound, and the resulting acidic products can be readily neutralized to form stable solutions which are useful as flotation agents.

U.S. Pat. No. 3,570,772 describes the use of di(4,5-carbon branched primary alkyl) dithiophosphate promoters for the flotation of copper middlings. The 4 and 5 carbon alcohols used as starting materials may be either single alcohols or mixtures of alcohols.

U.S. Pat. No. 3,298,520 issued to Bikales relates to the use of 2-cyanovinyldithiocarbamates which are useful as promotors in benefication of ores by froth flotation.

U.S Pat. No. 4,372,864 issued to McCarthy relates to a reagent which is useful in the recovery of bituminous coal in froth flotation processes. The reagent of the invention comprises a liquid hydrocarbon, a reducing material and an activator material. The reducing material is phosphorus pentasulfide and the activator material is zinc ethylene bis(dithiocarbamate).

U.S. Pat. No. 4,514,293 issued to Bresson et al and U.S. Pat. No. 4,554,108 issued to Kimble et al relate to the use of N-carboxyalkyl-S-carboalkoxydithiocarbamates and carboxyalkyldithiocarbamates, respectively, as ore flotation reagents.

U.S. Pat. No. 4,595,538 issued to Kimble et al relates to the use of trialkali metal or triammonium N,N-bis(-carboxyalkyl)dithiocarbamates as ore flotation depressants.

U.S. Pat. No. 3,876,550 issued to Holubec relates to lubricant compositions containing an additive combination which comprises (A) an alkylene dithiocarbamate and (B) a rust inhibitor based on a hydrocarbon-substituted succinic acid or certain derivatives thereof.

U.S. Pat. Nos. 1,726,647 and 1,736,429 issued to Cadwell relate to phenylmethylene bisdithiocarbamates and methods for preparing the same.

U.S. Pat. Nos. 4,040,950 issued to Zeparian, 4,584,097 issued to Fu et al, and 4,699,712 issued to Unger relate to a mixture of a dithiophosphorus acid or salt with a thionocarbamate in an ore flotation process.

U.S. Pat. No. 4,879,022 issued to Clark et al relates to dithiophosphorus acid or salt used in a flotation process utilizing sulfurous acid. Thionocarbamate is disclosed as an auxilliary collector.

Procedures for the selective flotation of copper minerals from copper sulfide ores wherein a slurry of ore and water is prepared and sulfurous acid is added to the slurry to condition the slurry prior to the froth flotation step have been discussed in, for example, U.S. Pat. Nos. 4,283,017 and 4,460,459. Generally, the pulp is conditioned with sulfur dioxide as sulfurous acid under intense aeration.

SUMMARY OF THE INVENTION

The present invention relates to improved process for beneficiating an ore-containing sulfide material. In particular, the process is useful for beneficiating ores and recovering metals such as gold, copper, lead, molybdenum, zinc, etc., from the ores. In one embodiment, the process comprises the steps of:

(1) forming a slurry comprising at least one crushed mineral-containing ore, water and a collector which is a mixture of (A) at least one metal salt of a phosphorus acid represented by the Formula:

$$(R_1)_2-\overset{\overset{\displaystyle X}{\|}}{P}-XH \qquad (I)$$

wherein each $R_1$ is independently a hydrocarbyl, hydrocarbyloxy or hydrocarbylthio group having from 1 to about 18 carbon atoms, each X is independently oxygen or sulfur, and the lowest oxidation state of the metal is plus two, and (B) at least one thio compound comprising (i) at least one dithiocarbamate represented by the formula:

$$R_2(R_3)N-\overset{\overset{\displaystyle S}{\|}}{C}-S-R_4-S-\overset{\overset{\displaystyle S}{\|}}{C}-N(R_3)R_2 \qquad \text{(II)}$$

wherein each $R_2$ is independently hydrogen, a hydrocarbyl group having from 1 to about 18 carbon atoms, or $R_2$ taken together with $R_3$ and the nitrogen atom form a five, six or seven member heterocyclic group; each $R_3$ is independently a hydrocarbyl group having from 1 to about 18 carbon atoms, or $R_3$ taken together with $R_2$ and the nitrogen atom form a five, six or seven member heterocyclic group; and $R_4$ is a hydrocarbylene group having from 1 to about 10 carbon atoms, (ii) at least one thionocarbamate represented by the Formula $$R_5-NH-\overset{\overset{\displaystyle S}{\|}}{C}-OR_6 \qquad \text{(III)}$$

wherein $R_5$ and $R_6$ are hydrocarbyl groups having from to about 18 carbon atoms or mixtures of (i) and (ii);

(2) subjecting the slurry from step (1) to froth flotation to produce a froth; and (3) recovering a mineral from the froth.

DETAILED DESCRIPTION OF THE INVENTION

In the specification and claims, the term hydrocarbylene or alkylene is meant to refer to a divalent hydrocarbyl or hydrocarbon group, such as methylene, ethylene, and like groups.

The term "hydrocarbyl" includes hydrocarbon, as well as substantially hydrocarbon, groups. Substantially hydrocarbon describes groups which contain non-hydrocarbon substituents which do not alter the predominantly hydrocarbon nature of the .group. Non-hydrocarbon substituents include halo (especially chloro and fluoro), hydroxy, alkoxy, mercapto, alkylmercapto, nitro, nitroso, sulfoxy, etc., groups. The hydrocarbyl group may also have a heteroatom, such as sulfur, oxygen, or nitrogen, in a ring or chain. In general, no more than about 2, preferably no more than one, non-hydrocarbon substituent will be present for every ten carbon atoms in the hydrocarbyl group. Typically, there will be no such non-hydrocarbon substituents in the hydrocarbyl group. Therefore, the hydrocarbyl group is purely hydrocarbon.

The froth flotation process of the present invention is useful to beneficiate sulfide mineral and metal values from sulfide ores including, for example, copper, lead, molybdenum, zinc, etc. Gold may be beneficiated as native gold or from such gold-bearing minerals as sylvanite ($AuAgTe_2$) and calaverite (AuTe). Silver can be beneficiated from argentite ($Ag_2S$). Lead can be beneficiated from minerals such as galena (PbS) and zinc can be beneficiated from minerals such as sphalerite (ZnS). Cobalt-nickel sulfide ores such as siegenite or linnalite can be beneficiated in accordance with this invention. The copper can be beneficiated from minerals such as calcocite ($Cu_2S$), covellite (CuS), bornite ($Cu_5FeS_4$), chalcopyrites ($CuFeS_2$) and copper-containing minerals commonly associated therewith. The invention is useful particularly in beneficiating the complex copper sulfide minerals such as the porphyry copper-molybdenum ores obtained from the Southwest of the United States of America. The complex sulfide ores contain large amounts of pyrite, (and other iron sulfides) which generally are relatively difficult to separate from the desired minerals.

In the following description of the invention, however, comments primarily will be directed toward the beneficiation and recovery of copper minerals, and it is intended that such discussion shall also apply to the other above-identified minerals.

The ores which are treated in accordance with the process of the present invention must be reduced in particle size to provide ore particles of flotation size. As is apparent to those skilled in the art, the particle size to which an ore must be reduced in order to liberate mineral values from associated gangue and non-value metals will vary from ore to ore and depends upon several factors, such as, for example, the geometry of the mineral deposits within the ore, e.g., striations, agglomerations, etc. Generally, suitable particle sizes are minus 10 mesh (1000 microns) (Tyler) with 50% or more passing 200 mesh (70 microns). The size reduction of the ores may be performed in accordance with any method known to those skilled in the art. For example, the ore can be crushed to about minus 10 mesh (1000 microns) size followed by wet grinding in a steel ball mill to specified mesh size ranges. Alternatively, pebble milling may be used. The procedure used in reducing the particle size of the ore is not critical to the method of this invention so long as particles of effective flotation size are provided.

Water is added to the grinding mill to facilitate the size reduction and to provide an aqueous pulp or slurry. The amount of water contained in the grinding mill may be varied depending on the desired solid content of the pulp or slurry obtained from the grinding mill. Conditioning agents may be added to the grinding mill prior to or during the grinding of crude ore. Optionally, water-soluble inorganic bases and/or collectors also may be included in the grinding mill.

At least one collector of the present invention is added to the grinding mill to form the aqueous slurry or pulp. The collector may be added prior to, during, or after grinding of the crude ore. The collector of the present invention is a mixture of (A) a metal salt of a phosphorus acid and (B) a thio compound comprising (i) a dithiocarbamate, (ii) a thionocarbamate or mixtures of (i) and (ii).

Phosphorus Acid Salts

The phosphorus acid is represented by the Formula $$(R_1)_2-\overset{\overset{\displaystyle X}{\|}}{P}-XH \qquad \text{(I)}$$

wherein each $R_1$ is independently a hydrocarbyl, hydrocarbyloxy, or a hydrocarbylthio group having from 1 to about 18 carbon atoms and each X is independently oxygen or sulfur.

Preferably, each $R_1$ independently contains from 1 to about 8 carbon atoms, more preferably about 3 to about 6. Preferably, $R_1$ is an alkyl, aryl, alkoxy, aryl, aryloxy, alkylthio or arylthio group, more preferably an alkyl, aryl, alkoxy or aryloxy group, with an alkoxy or aryloxy group being more preferred. Each $R_1$ may be derived from any of the monohydroxy organic compounds listed below. Examples of $R_1$ include propyl, propoxy, propylthio, butyl, butoxy, butylthio, amyl, amyloxy, amylthio, hexyl, hexyloxy and hexylthio groups. The above list is meant to include all stereo arrangements of the above groups. For instance, butyl is meant to include isobutyl, sec-butyl, n-butyl, etc. In a preferred embodiment, one $R_1$ is a isopropoxy or isobutoxy group and the other $R_1$ is an amyloxy or a methylamyloxy group.

When $R_1$ is an aryl, aryloxy or arylthio group, $R_1$ contains from 6 to about 18 carbon atoms, more preferably 6 to about 10. Examples of aromatic $R_1$ groups include cresyl, cresyloxy, cresy)thio, xylyl, xylyloxy, xylylthio, heptylphenol, and heptylphenolthio groups, preferably cresyl or cresyloxy groups.

In Formula I, X may be oxygen or sulfur, more preferably sulfur. In one embodiment, one X is oxygen and the other X is sulfur. In another embodiment, each X is sulfur.

The phosphorus aoids useful in the present invention include phosphoric; phosphonic; phosphinic; thiophosphoric; thiophosphinic; or thiophosphonic acids. Use of the terms thiophosphoric, thiophosphonic and thiophosphinic acids is meant to encompass monothio as well as dithio forms of these acids. The phosphorus acids are known compounds and may be prepared by known methods. Preferably, the phosphorus acid is a dithiophosphoric acid.

Dithiophosphoric acids are known compounds and may be prepared by the reaction of a mixture of hydroxy-containing organic compounds such as alcohols and phenols with a phosphorus sulfide such as $P_2S_5$. The dithiophosphoric acids generally are prepared by reacting from about 3 to 5 moles, more generally 4 moles of the hydroxy-containing organic compound (alcohol or phenol) with one mole of phosphorus pentasulfide in an inert atmosphere at temperatures from about 50° C. to about 200° C. with the evolution of hydrogen sulfide. The reaction normally is completed in about 1 to 3 hours.

Monohydroxy organic compounds useful in the preparation of the dihydrocarbylphosphorodithioic acids and salts useful in the present invention include alcohols, phenol and alkyl phenols including their substituted derivatives, e.g., nitro-, halo-, alkoxy-, hydroxy-, carboxy-, etc. Suitable alcohols include, for example, ethanol, n-propanol, isopropanol, n-butanol, 2-butanol, 2-methyl-propanol, n-pentanol, 2-pentanol, 3-pentanol, 2-methylbutanol, 3-methyl-2-pentanol, n-hexanol, 2-hexanol, 3-hexanol, 4-methyl-2-pentanol, 2-methyl-3-pentanol, cyclohexanol, chlorocylohexanol, methylcyclohexanol, heptanol, 2-ethylhexanol, n-octanol, nonanol, dodecanol, etc. The phenols suitable for the purposes of the invention include alkyl phenols and substituted phenols such as phenol, chlorophenol, bromophenol, nitrophenol, methoxyphenol, cresol, propylphenol, heptylphenol, octylphenol, decylphenol, dodecylphenol, and commercially available mixtures of phenols. The aliphatic alcohols containing from about 4 to 6 carbon atoms are particularly useful in preparing the dithiophosphoric acids.

In a preferred embodiment, the composition of the phosphorodithioic acid obtained by the reaction of a mixture of hydroxy-containing organic compounds with phosphorus pentasulfide is actually a statistical mixture of phosphorodithioic acids wherein one hydrocarbyl group may be derived from the same hydroxy compound as the other hydrocarbyl group, or one hydrocarbyl group may be derived from a different hydroxy compound than the other hydrocarbyl group. In the present invention it is preferred to select the amount of the two or more hydroxy compounds reacted with $P_2P_5$ to result in a mixture in which the predominating dithiophosphoric acid is the acid (or acids) containing two different hydrocarbyl groups.

Typical mixtures of alcohols and phenols which can be used in the preparation of dithiophosphoric acids and salts of Formula I include: isobutyl and n-amyl alcohols; sec-butyl and n-amyl alcohols; propyl and n-hexyl alcohols; isobutyl alcohol, n-amyl alcohol and 2-methyl-1-butanol; phenol and n-amyl alcohol; phenol and cresol, etc.

Salts of the above phosphorus acid may be prepared by techniques known to those in the art. The acids are usually reacted with metal bases. The metal bases are generally oxides, hydroxides, etc., of metals having a plus two as their lowest oxidation state. Typically, the metals include Group IIA, IIB–VIIB and VIII metals, preferably Group IIB–VIIB and VIII metals, more preferably Group IIB, IVB, VIIB and VIII metals. The above group numbers correspond to the CAS designation of groups in the Periodic Table of Elements Preferably, the metals include calcium, magnesium, titanium, chromium, manganese, iron, cobalt, nickel and zinc, more preferably titanium, manganese, iron, cobalt and zinc, with zinc being highly preferred.

The phosphorodithioic acids and salts useful as collectors in the process of the present invention are exemplified by the acids and salts prepared in the following examples. Unless otherwise indicated in the following examples or elsewhere in the specification and claims, all parts and percentages are by weight and all temperatures are in degrees centigrade.

EXAMPLE 1

A reaction vessel is charged with 804 parts of a mixture of 6.5 moles of isobutyl alcohol and 3.5 moles of mixed primary amyl alcohols (65%w n-amyl and 35%w 2-methyl-1-butanol). Phosphorus pentasulfide (555 parts, 2.5 moles) is added to the vessel while maintaining the reaction temperature between about 104°–107° C. After all of the phosphorus pentasulfide is added, the mixture is heated for an additional period to insure completion of the reaction and filtered. The filtrate is the desired phosphorodithioic acid which contains about 11.2% phosphorus and 22.0% sulfur.

A reaction vessel is charged with a mixture of 448 parts of zinc oxide (11 equivalents), 467 parts of the above alcohol mixture. The above phosphorodithioic acid (3030 parts, 10.5 equivalents) is added at a rate to maintain the reaction temperature at about 45°–50° C. The addition is completed in 3.5 hours whereupon the temperature of the mixture is raised to 75° C. for 45 minutes. After cooling to about 50° C., an additional 61 parts of zinc oxide (1.5 equivalents) are added, and this mixture is heated to 75° C. for 2.5 hours. After cooling to ambient temperature, the mixture is stripped to 124° C. at 12 mm. pressure. The residue is filtered twice through diatomaceous earth, and the filtrate is the desired zinc salt containing 22.2% sulfur (theory, 22.0), 10.4% phosphorus (theory, 10.6) and 10.6% zinc (theory, 11.1).

EXAMPLE 2

A reaction vessel is charged with a mixture of 246 parts (2 equivalents) of Cresylic Acid 33 (a mixture of mono-, di- and tri-substituted alkyl phenols containing from 1 to 3 carbon atoms in the alkyl group commercially available from Merichem Company of Houston, Tex.), 260 parts (2 equivalents) of isooctyl alcohol and 14 parts of caprolactam. The mixture is heated to 55° C. under a nitrogen atmosphere, where phosphorus pentasulfide (222 parts, 2 equivalents) is added in portions over a period of one hour while maintaining the temperature at about 78° C. The mixture is maintained at this temperature for an additional hour until completion of the phosphorus pentasulfide addition and then cooled to room temperature. The reaction mixture is filtered through diatomaceous earth and the filtrate is the desired phosphorodithioic acid.

A reaction vessel is charged with a mixture of 63 parts (1.55 equivalents) of zinc oxide, 144 parts of mineral oil and one part of acetic acid. A vacuum is applied and 533 parts (1.3 equivalents) of the above phosphorodithioic acid are added while heating the mixture to about 80° C. The temperature is maintained at 80°-85° C. for about 7 hours after the addition of the phosphorodithioic acid is complete. The residue is filtered, and the filtrate is the desired product containing 6.8% phosphorus.

EXAMPLE 3

A reaction vessel is charged with a mixture of 2945 parts (24 equivalents) of Cresylic Acid 57 (Merichem) and 1152 parts (6 equivalents) of heptylphenol. The mixture is heated to 105° C. under a nitrogen atmosphere whereupon 1665 parts (15 equivalents) of phosphorus pentasulfide are added in portions over a period of 3 hours while maintaining the temperature of the mixture between about 115°-120° C. The mixture is maintained at this temperature for an additional 1.5 hours upon completion of addition of the phosphorus pentasulfide and then cooled to room temperature. The reaction mixture is filtered through a diatomaceous earth and the filtrate is the desired phosphorodithioic acid.

A reaction vessel is charged with a mixture of 541 parts (13.3 equivalents) of zinc oxide, 14.4 parts (0.24 equivalent) of acetic acid and 1228 parts of mineral oil. A vacuum is applied while raising the temperature to about 70° C. The above phosphorodithioic acid (4512 parts, 12 equivalents) is added over a period of about 5 hours while maintaining the temperature at 68°-72° C. Water is removed as it forms in the reaction, and the temperature is maintained at 68°-72° C. for 2 hours after the addition of phosphorodithioic acid is complete. To insure complete removal of water, vacuum is adjusted to about 10 mm Hg, and the temperature is raised to about 105° C. and maintained for 2 hours. The residue is filtered, and the filtrate is the desired product containing 6.26% phosphorus (theory, 6.09) and 6.86% zinc (theory, 6.38).

Dithiocarbamate

The dithiocarbamate is represented by the Formula $$R_2(R_3)N-\overset{\overset{\displaystyle S}{\|}}{C}-S-R_4-S-\overset{\overset{\displaystyle S}{\|}}{C}-N(R_3)R_2 \qquad \text{(II)}$$

wherein $R_2$, $R_3$, and $R_4$ are as defined below.

Each $R_2$ is independently a hydrogen; a hydrocarbyl group having from 1 to about 18 carbon atoms, preferably 1 to about 10, more preferably 1 to about 6; or $R_2$ taken together with $R_3$ and the nitrogen atom form a five, six or seven member heterocyclic group. Preferably, each $R_2$ is independently a hydrogen or a propyl, butyl, amyl or hexyl group, more preferably a butyl group. The above list encompasses all stereo arrangements of these groups, including isopropyl, n-propyl, isobutyl, sec-butyl, and n-butyl.

Each $R_3$ is independently a hydrocarbyl group having from 1 to about 18 carbon atoms, or $R_3$ taken together with $R_2$ and the nitrogen atom form a five, hydrocarbyl group, it is defined the same as when $R_2$ is a hydrocarbyl group.

When $R_2$ and $R_3$ are taken together with a nitrogen atom to form a five, six or seven member heterocyclic group, the heterocyclic group is a pyrrolidinyl, a piperidinyl, a morpholinyl or a piperazinyl group. The heterocyclic group may contain one or more, preferably one to three alkyl substituents on the heterocyclic ring. The alkyl substituents preferably contain from about one to about six carbon atoms. Examples of heterocyclic groups include 2-methylmorpholinyl, 3-methyl-5-ethylpiperidinyl, 3-hexylmorpholinyl, tetramethylpyrrolidinyl, piperazinyl, 2,5-dipropylpiperazinyl, piperidinyl, 2-butylpiperazinyl, 3,4,5-triethylpiperidinyl, 3-hexylpyrrolidinyl, and 3-ethyl-5-isopropylmorpholinyl groups. Preferably, the heterocyclic group is a pyrrolidinyl or piperidinyl group.

In one embodiment, each $R_2$ is independently a hydrogen, or a hydrocarbyl group and each $R_3$ is independently a hydrocarbyl group. In another embodiment, one $R_2$ and $R_3$ taken together with a nitrogen atom form a five, six or seven member heterocyclic group while the other $R_2$ is independently a hydrogen or a hydrocarbyl group and the other $R_3$ is a hydrocarbyl group. In another embodiment, each $R_2$ and $R_3$ together with the nitrogen atoms form a five, six or seven member heterocyclic group.

$R_4$ is a hydrocarbylene group having from 1 to about 10 carbon atoms. Preferably, $R_4$ is an alkylene, arylene, alkarylene, or arylalkylene. In one embodiment, $R_4$ is an alkylene group having from 1 to about 10 carbon atoms, preferably 1 to about 4. Preferably, $R_4$ is a methylene or ethylene group, more preferably methylene.

In another embodiment, $R_4$ is an arylene group, alkarylene group, or arylalkylene group having from 6 to about 10 carbon atoms, preferably 6 to about 8 Preferably, $R_4$ is a phenylmethylene, phenylethyl-ene, phenyldiethylene, phenylene, tolylene, etc.

The dithiocarbamates useful as collectors in the present invention may be prepared by the reaction of a salt of a dithiocarbamate acid with a suitable dihalogen containing hydrocarbon in the presence of a suitable reaction medium. Suitable reaction media include alcohols, such as ethanol and methanol; ketones, such as acetone or methylethylketone; ethers, such as dibutylether or dioxane; and hydrocarbons, such as petroleum ether, benzene and toluene. The reaction is generally carried out at a temperature within the range of about 25° C. to about 150° C., more preferably about 25° C. to about 100° C.

U.S. Pat. No. 3,876,550 issued to Holubec describes lubricant compositions containing alkylene dithiocarbamic compounds. U.S. Pat. Nos. 1,726,647 and 1,736,429, issued to Caldwell, describe phenylmethylene bis(dithiocarbamates) and methods for making the same. These patents are incorporated by reference for their teachings relating to dithiocarbamate compounds and methods for preparing the same.

The following example relates to a dithiocarbamate useful in the process of the present invention.

EXAMPLE 4

A reaction vessel is charged with 1000 parts (7.75 moles) of di-n-butylamine, 650 parts (8.1 moles) of a 50% aqueous solution of sodium hydroxide, and 1356 parts of water. Carbon disulfide (603 parts, 7.9 moles) is added to the above mixture while the temperature of the reaction mixture is maintained under about 63° C. After completion of the addition of the carbon disulfide, methylene dichloride (363 parts, 4.3 moles) is added over four hours while the reaction mixture is heated to 88° C. After the addition of methylene dichloride, the mixture is heated for an additional three hours at a temperature in the range of 85° C.–88° C. The stirring is stopped and the aquesous phase is drained off. The reaction mixture is stripped to 150° C. and 50 millimeters of mercury. The residue is filtered. The product has 6.5% nitrogen and 30.0% sulfur.

Thionocarbamate

The thionocarbamate may be represented by the Formula $$R_5-NH-\overset{\overset{\displaystyle S}{\|}}{C}-OR_6 \qquad \text{(III)}$$

wherein each $R_5$ and $R_6$ are independently hydrocarbyl groups having from 1 to about 18 carbon atoms, preferably 1 to about 8, more preferably 1 to about 6. Preferably, each $R_5$ and $R_6$ are alkyl groups. Examples of alkyl groups include methyl, ethyl, propyl, butyl, amyl and hexyl groups. The above list is meant to include all stereo arrangements of those groups. Specific examples of thionocarbamates include O-hexyl,N-ethylthionocarbamate; O-butyl,N-methyl thionocarbamate; O-methyl,N-ethylthionocarbamate; and O-isopropyl,N-methylthionocarbamate. Minnerec Chemical 1661 and Dow Chemical Z-200 are commercially available 0-isopropyl,N-ethylthionocarbamates. Minnerec Chemical 1331 is a commercially available O-n-butyl,N-methylthionocarbamate.

The collector of the present invention is a mixture of (A) a metal salt of a phosphorus acid and (B) a thio compound comprising (i) a dithiocarbamate, (ii) a thionocarbamate or mixtures of (i) and (ii). The weight ratio of (A) to (B) is about (2–20:1) preferably about (5–15:1), more preferably (9:1).

The following are examples of collectors useful in the present invention. All percentages are percentages by weight.

Example A
90% of the product of Example 1
10% of the product of Example 4
Example B
85% of the product of Example 2
15% of the product of Example 4
Example C
90% of the product of Example 1
10% of O-isopropyl, N-ethylthionocarbamate
Example D
90% of zinc isopropyl, methyl-amyldithiophosphate
10% of the product of Example 4

The amount of the collector of the present invention included in the slurry to be used in the flotation process is an amount which is effective in promoting the froth flotation process and providing improved separation of the desired mineral values. The amount of collector of the present invention included in the slurry will depend upon a number of factors including the nature and type of ore, size of ore particles, etc. In general, the collector is present in an amount from about 0.5 to about 500 parts of collector per million parts of ore, preferably about 1 to about 50, more preferably 1.5 to about 40.

In the process of the present invention, a base may be included to provide desirable pH values. Desirable pH values are about 8 and above, preferably about 8 to about 13, more preferably about 9 to about 12, with about 10 to about 12 being highly preferred. Alkali and alkaline earth metal oxides and hydroxides are useful inorganic bases. Lime is a particularly useful base. In the process of the present invention, it has been discovered that the addition of a base to the ore or slurry containing the collectors of this invention results in a significant increase in the copper assay of the cleaner concentrates.

The mixtures used in this invention will contain from about 20% to about 50% by weight of solids, and more generally from about 30% to 40% solids. Such slurries can be prepared by mixing all the above ingredients. Alternatively, the collector and inorganic base can be premixed with the ore either as the ore is being ground or after the ore has been ground to the desired particle size. Thus, in one embodiment, the ground pulp is prepared by grinding the ore in the presence of collector and inorganic base and this ground pulp is thereafter diluted with water to form the slurry. The amount of inorganic base included in the ground ore and/or the slurry prepared from the ore is an amount which is sufficient to provide the desired pH to the slurry. Generally, the amount of inorganic base is from about 250 to about 2000 parts of inorganic base per million parts of ore, preferably from about 375 to about 1500. This amount may be varied by one skilled in the art depending on particular preferences.

In step (2), the slurry is subjected to a froth flotation to form a froth and an underflow. Most of the copper values are recovered in the froth (concentrate) while significant quantities of undesirable minerals and gangue are contained in the underflow. The flotation stage of the flotation system comprises at least one flotation stage wherein a rougher concentrate is recovered, and/or one or more cleaning stages wherein the rougher concentrate is cleaned and upgraded. Tailing products from each of the stages can be routed to other stages for additional mineral recovery.

The copper rougher flotation stage will contain at least one frother, and the amount of frother added will be dependent upon the desired froth characteristics which can be selected with ease by one skilled in the art. A typical range of frother addition is from about 20 to about 50 parts of frother per million parts of dry ore.

A wide variety of frothing agents have been used successfully in the flotation of minerals from base metal sulfide ores, and any of the known frothing agents can be used in the process of the present invention. By way of illustration, such frothing agents as straight or branched chain low molecular weight hydrocarbon alcohols such as $C_{6-8}$ alkanols, 2-ethylhexanol and 4-methyl-2-pentanol (also known as methylisobutylcarbinol, MIBC) may be employed as well as pine oils, cresylic acid, polyglyool or monoethers of polyglycols and alcohol ethoxylates.

An essential ingredient of the slurry contained in the copper rougher stage is one or more of the collectors described above. In one embodiment, the collector is included in the slurry in step (2), and additional collector may be added during the flotation steps including the rougher stage as well as the cleaner stage. In addition to the collectors of the present invention, other types of collectors normally used in the flotation of sulfide ores can be used. The use of such auxiliary collectors in combination with the collectors of this invention often results in improved and superior recovery of more concentrated copper values. These auxiliary collectors also may be added either to the rougher stage or the cleaning stage, or both.

As noted above, the froth flotation step can be improved by the inclusion of auxiliary collectors in addition to the oollectors of the present invention. The most common auxiliary collectors are hydrocarbon compounds which contain anionic or cationic polar groups. Examples include the fatty acids, the fatty acid soaps, xanthates, xanthate esters, xanthogen formates, fatty sulfates, fatty sulfonates, mercaptans, and thioureas. The xanthates are particularly useful auxiliary collectors.

One group of xanthate collectors which has been utilized in froth flotation processes may be represented by the formula

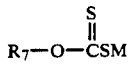

$$R_7-O-\overset{\overset{\displaystyle S}{\|}}{C}SM$$

wherein $R_7$ is an alkyl group containing from 1 to 6 carbon atoms and M is a dissociating cation such as sodium or potassium. Examples of such xanthates include potassium amyl xanthate, sodium amyl xanthate, etc.

Hydrocarboxycarbonyl thionocarbamate compounds also have been reported as useful collectors for beneficiating sulfide ores. The hydrocarboxycarbonyl thionocarbamate compounds are represented by the formula

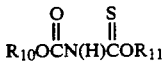

$$R_{10}O\overset{\overset{\displaystyle O}{\|}}{C}N(H)\overset{\overset{\displaystyle S}{\|}}{C}OR_{11}$$

wherein $R_{10}$ and $R_{11}$ are each independently selected from saturated and unsaturated hydrocarbyl groups, alkyl polyether groups and aromatic groups. The preparation of these hydrocarboxycarbonyl thionocarbamic compounds and their use as collectors is described in U.S. Pat. No. 4,584,097, the disclosure of which is hereby incorporated by reference. Specific examples of auxiliary collectors which may be utilized in combination with the collectors of the present invention include: sodium isopropyl xanthate, N-ethoxycarbonyl N'-isopropylthiourea, etc.

In the flotation step (2), the slurry is frothed for a period of time which maximizes copper recovery. The precise length of time is determined by the nature and particle size of the ore as well as other factors, and the time necessary for each individual ore can be readily determined by one skilled in the art. Typically, the froth flotation step is conducted for a period of from 2 to about 20 minutes and more generally from a period of about 5 to about 15 minutes. As the flotation step proceeds, small amounts of collectors may be added periodically to improve the flotation of the desired mineral values. Additional amounts of the collector of the present invention may be added periodically to the rougher concentrate and included in the slurry.

When the froth flotation has been conducted for the desired period of time, the copper rougher concentrate is collected, and the copper rougher tailing product is removed and may be subjected to further purification.

The recovered copper rougher concentrate may be processed further to improve the copper grade and reduce the impurities within the concentrate. One or more cleaner flotation stages can be employed to improve the copper grade to a satisfactory level without unduly reducing the overall copper recovery of the system. Generally, two cleaner flotation stages have been found to provide satisfactory results.

Prior to cleaning, however, the copper rougher concentrate is finely reground to reduce the particle size to a desirable level. In one embodiment, the particle size is reduced so that 60% is less than 400 mesh (35 microns). The entire copper rougher concentrate can be comminuted to the required particle size or the rougher concentrate can be classified and only the oversized materials comminuted to the required particle size. The copper rougher concentrate can be classified by well-known means such as hydrocyclones. The particles larger than desired are reground to the proper size and are recombined with the remaining fraction.

The reground copper rougher concentrate then is cleaned in a conventional way by forming an aqueous slurry of the reground copper rougher concentrate in water. One or more frothers and one or more collectors are added to the slurry which is then subjected to a froth flotation. The collector utilized in this cleaner stage may be one or more of the collectors of the present invention and/or any of the auxiliary collectors described above. In some applications, the addition of collector and a frother to the cleaning stage may not be necessary if sufficient quantities of the reagents have been carried along with the concentrate from the preceding copper rougher flotation. The duration of the first copper cleaner flotation is a period of from about 5 to about 20 minutes, and more generally for about 8 to about 15 minutes. At the end of the cleaning stage, the froth containing the copper cleaner concentrate is recovered and the underflow which contains the copper cleaner tailings is removed. In one preferred embodiment, the copper cleaner concentrate recovered in this manner is subjected to a second cleaning stage and which the requirements for collector and frother, as well as the length of time during which the flotation is carried out to obtain a highly satisfactory copper content and recovery oan be readily determined by one skilled in the art.

In another embodiment, the slurry from step (1) is subjected to conditioning with sulfurous acid. The conditioning acts to suppress iron while enhancing copper recovery. After the ore slurry has been prepared in accordance with any of the embodiments described above, it is useful in some flotation procedures to condition the slurry with sulfur dioxide under aeration at a pH of from about 5.5 to about 7.5. The conditioning medium may be an aqueous solution formed by dissolving sulfur dioxide in water forming sulfurous acid ($H_2SO_3$). It has been found that when certain ore slurries are conditioned with sulfurous acid and aerated, the $SO_2$ increases the flotation rate of copper minerals, and depresses the undesired gangue and undesirable minerals such as iron resulting in the recovery in subsequent treatment stages of a product that represents a surprising high recovery of copper values and a surprising low retention of iron. The amount of sulfur dioxide added to the slurry in the conditioning step can be varied over a wide range, and the precise amounts useful for a particular ore or flotation process can be readily determined by one skilled in the art. In general, the amount of sulfur dioxide utilized in the conditioning step is within the range of from about 500 to about 5000 parts of sulfur dioxide per million parts of ground ore. The pH of the conditioned slurry should be maintained between about 5.5 and about 7.5, more preferably between about 6.0 to about 7.0. A pH of about 6.5 to about 7.0 is particularly preferred for the conditioned slurry.

Conditioning of the slurry is achieved by agitating the pulp contained in a conditioning tank such as by vigorOus aeration and optionally, with a suitable agitator such as a motor-driven impeller, to provide good solid-liquid contact between the finely divided ore and the sulfurous acid. The pulp is conditioned sufficiently long to maximize depression of the undesirable minerals and gangue while maximizing activation of the desired minerals such as copper minerals. Thus, conditioning time will vary from ore to ore, but it has been found for the ores tested that conditioning times of between about 1 to 10 minutes and more generally from about 3 to 7 minutes provide adequate depression of the undesirable minerals and gangue.

One of the advantages of the conditioning step is that it allows recovery of a concentrate having satisfactory copper content without requiring the introduction of lime, cyanide or other conditioning agents to the flotation circuit, although as mentioned above, the introduction of some lime frequently improves the results obtained. Omitting these other conditioning agents, or reducing the amounts of lime or other conditioning agents offers relief for both the additional costs and the environmental and safety factors presented by these agents. However, as noted below, certain advantages are obtained when small amounts of such agents are utilized in the flotation steps.

When using the sulfurous acid conditioning step, the flotation of copper is effected in the copper rougher stage at a slightly acidic pulp pH which is generally between about 6.0 and 7.0, the pH being governed by the quantity of sulfur dioxide used during the conditioning and aeration as well as the quantity of any inorganic base included in the slurry.

When the process of the present invention is carried out on copper sulfide ores, and in particular, copper sulfide ores from the Southwest of the United States of America, cleaned copper concentrates are found to contain high concentrations of copper with improved recoveries.

The following table contains results of flotation tests conducted on a copper molybdenum ore having an average ore assay of 0.88% copper and 0.05% molybdenum. The test results were obtained by adding the indicated amount of collector to the ore and diluting with water to 60% solids to form a slurry. The slurry is ground for 20 minutes. The slurry has a pH of approximately 8 9–9.3. Air is introduced into the slurry to form a froth and the froth is collected twice for 3 minutes and 7 minutes respectively.

| Collector | Amount of Collector[1] | % Copper Recovery | % Molybdenum Recovery |
|---|---|---|---|
| Example A | 5.9 | 93.5 | not analyzed |
| | 8.8 | 95.6 | not analyzed |
| | 17.7 | 95.0 | not analyzed |
| Example C | 9.4 | 92.7 | not analyzed |
| | 18.8 | 95.3 | not analyzed |
| Aerofloat ® 25 | 12.5 | 90.6 | not analyzed |
| | 17.5 | 91.4 | not analyzed |
| | 25.0 | 93.8 | not analyzed |
| Example D | 3.7 | not analyzed | 48.4 |
| | 4.9 | not analyzed | 52.7 |
| Aerofloat ® 25 | 12.5 | not analyzed | 52.8 |

[1]part of collector per million parts of ore
[2]Aerofloat ® 25, a dicresyldithiophosphoric acid collector available from American Cyanamid Chemical Company As can be seen from the above table, the collectors of the present invention show significantly improved recovery of copper at an equal or lower treatment level than Aerofloat ®25. Further, the collectors of the present invention provide equal recovery of molybdenum at significantly lower collector treatment levels.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. A mineral recovery process comprising the steps of:

(1) forming a slurry comprising at least one crushed mineral-containing ore, water and a collector for said mineral which is a mixture of (A) at least one metal salt of a phosphorus acid represented by the Formula:

$$(R_1)_2-\overset{\overset{X}{\|}}{P}-XH \qquad (I)$$

wherein each $R_1$ is independently a hydrocarbyl, hydrocarbyloxy or hydrocarbylthio group having from 1 to about 18 carbon atoms, each X is independently oxygen or sulfur, and the metal is selected from metals in Groups IIB–VIIB and VIII of the periodic table, and (B) at least one thio compound comprising (i) at least one dithiocarbamate represented by the formula:

$$R_2(R_3)N-\overset{\overset{S}{\|}}{C}-S-R_4-S-\overset{\overset{S}{\|}}{C}-N(R_3)R_2 \qquad (II)$$

wherein each $R_2$ is independently hydrogen, a hydrocarbyl group having from 1 to about 18 carbon atoms, or an $R_2$ taken together with $R_3$ and the nitrogen atom form a five, six or seven member heterocyclic group; each $R_3$ is independently a hydrocarbyl group having from 1 to about 18 carbon atoms, or an $R_3$ taken together with $R_2$ and the nitrogen atom form a five, six or seven member heterocyclic group; and $R_4$ is a hydrocarbylene group having from 1 to about 10 carbon atoms, (ii) at least one thionocarbamate represented by the Formula $$R_5-NH-\overset{\overset{\displaystyle S}{\|}}{C}-OR_6 \quad \text{(III)}$$

wherein $R_5$ and $R_6$ are hydrocarbyl groups having from 1 to about 18 carbon atoms or mixtures of (i) and (ii);

(2) subjecting the slurry from step (1) to froth flotation at a pH of 8 and above to produce a froth containing said mineral; and (b 3) recovering said mineral from the froth.

2. The process of claim 1, wherein each $R_1$ is independently an alkyl or alkoxy group having from 1 to about 18 carbon atoms or an aryl or aryloxy group having from about 6 to about 18 carbon atoms.

3. The process of claim 1, wherein each $R_1$ is independently an alkoxy group having from 1 to about 8 carbon atoms.

4. The process of claim 1, wherein each $R_1$ is independently a propoxy, butoxy, amyloxy or hexyloxy group.

5. The process of claim 1, wherein each $R_1$ is independently an aryloxy group having from 6 to about 10 carbon atoms.

6. The process of claim 1, wherein each $R_1$ is independently a cresyloxy, xylyloxy or heptylphenyloxy group.

7. The process of claim 1, wherein X is sulfur.

8. The process of claim 1, wherein the metal is titanium, chromium, manganese, iron, cobalt, nickel or zinc.

9. The process of claim 1, wherein the metal is zinc.

10. The process of claim 1, wherein the thio compound (B) is (i).

11. The process of claim 10, wherein each $R_2$ is independently hydrogen or a hydrocarbyl group having from 1 to about 8 carbon atoms; and each $R_3$ is independently a hydrocarbyl group having from 1 to about 8 carbon atoms.

12. The process of claim 10, wherein each $R_2$ is independently hydrogen or a propyl, butyl, or amyl group; and each $R_3$ is independently a propyl, butyl, or amyl group.

13. The process of claim 10, wherein $R_2$ and $R_3$ taken together with the nitrogen atom form a pyrrolidinyl or piperidinyl group.

14. The process of claim 10, wherein one $R_2$ and one $R_3$ taken together with the nitrogen atom form a pyrrolidinyl or piperidinyl group; the other $R_2$ is a hydrogen or a propyl, butyl, or amyl group; and the other $R_3$ is a propyl, butyl, or amyl group.

15. The process of claim 10, wherein $R_4$ is an alkylene group.

16. The process of claim 10, wherein $R_4$ is a methylene or ethylene group.

17. The process of claim 10, wherein $R_4$ is an arylene, alkarylene or arylkylene group containing from 6 to about 10 carbon atoms.

18. The process of claim 1, wherein the thio compound (B) is (ii).

19. The process of claim 18, wherein $R_5$ and $R_6$ each are independently an alkyl group having 1 to about 8 carbon atoms.

20. The process of claim 18, wherein $R_5$ and $R_6$ are each independently an ethyl, propyl, butyl or amyl group.

21. The process of claim 1, wherein the ore is a gold- or copper-mineral-containing ore.

22. The process of claim 1, wherein step (1) further comprises:

including an inorganic base in the slurry.

23. The process of claim 22 wherein the inorganic base is an alkali metal or alkaline earth metal oxide or hydroxide.

24. The process of claim 1, wherein step (1) further comprises:

conditioning the slurry with $SO_2$ until the slurry has a pH of from about 4.5 to about 7.0 prior to step (2).

25. The process of claim 1, wherein the collector is present in an amount from about 0.5 to about 500 parts of collector per million parts of ore.

26. The process of claim 1, wherein the weight ratio of (A) to (B) is about (2–20:1).

27. The process of claim 1, further comprising (4) cleaning and upgrading the minerals recovered in step (3).

28. A mineral recovery process comprising the steps of:

(1) forming a slurry comprising at least one crushed gold- or copper-mineral containing ore, water and from 0.5 to 500 parts of at least one collector for said mineral per million parts of ore, wherein the collector is a mixture of (A) at least one metal salt of dithiophosphorus acid represented by the Formula $$(R_1)_2-\overset{\overset{\displaystyle S}{\|}}{P}-SH \quad \text{(I)}$$

wherein each $R_1$ is independently a propoxy, butoxy, amyloxy or hexyloxy group and the metal is selected from the metals in Groups IIB–VIIB and VIII of the periodic table, and (B) at least one thio compound comprising (i) at least one dithiocarbamate represented by the formula:

$$R_2(R_3)N-\overset{\overset{\displaystyle S}{\|}}{C}-S-R_4-S-\overset{\overset{\displaystyle S}{\|}}{C}-N(R_3)R_2 \quad \text{(II)}$$

wherein each $R_2$ is independently hydrogen, a propyl, butyl, or amyl group; each $R_3$ is independently a propyl, butyl, or amyl group; and $R_4$ is a methylene or ethylene group, (ii) at least one thionocarbamate represented by the Formula:

$$R_5-NH-\overset{\overset{\displaystyle S}{\|}}{C}-OR_6 \quad \text{(III)}$$

wherein $R_5$ and $R_6$ are each independently an ethyl, propyl or butyl group or mixtures of (i) and (ii);

(2) subjecting the slurry from step (1) to froth flotation at a pH of 8 and above to produce a froth containing said mineral; and (3) recovering said mineral from the froth.

29. The process of claim 1, wherein step (2) occurs at a pH from about 9 to about 12.

30. the process of claim 18, wherein step (2) occurs at a pH from about 9 to about 12.

* * * * *